US011306508B2

(12) United States Patent
Lu

(10) Patent No.: US 11,306,508 B2
(45) Date of Patent: Apr. 19, 2022

(54) DOOR LOCKING SYSTEM

(71) Applicant: Glen Lu, Great Neck, NY (US)

(72) Inventor: Glen Lu, Great Neck, NY (US)

( * ) Notice: Subject to any disclaimer, the term of this patent is extended or adjusted under 35 U.S.C. 154(b) by 493 days.

(21) Appl. No.: 16/450,942

(22) Filed: Jun. 24, 2019

(65) Prior Publication Data

US 2020/0399930 A1 Dec. 24, 2020
US 2021/0238886 A9 Aug. 5, 2021

Related U.S. Application Data

(60) Provisional application No. 62/689,066, filed on Jun. 23, 2018.

(51) Int. Cl.

| | |
|---|---|
| ***E05B 37/00*** | (2006.01) |
| ***E05C 1/00*** | (2006.01) |
| ***E05B 1/00*** | (2006.01) |
| ***E05B 47/06*** | (2006.01) |
| ***E05B 47/00*** | (2006.01) |
| *E05B 9/04* | (2006.01) |
| *E05B 15/00* | (2006.01) |

(52) U.S. Cl.

CPC ..... *E05B 37/0034* (2013.01); *E05B 1/0007* (2013.01); *E05B 37/0072* (2013.01); *E05B 47/0038* (2013.01); *E05B 47/0607* (2013.01); *E05B 47/0615* (2013.01); *E05C 1/002* (2013.01); *E05B 9/04* (2013.01); *E05B 15/0033* (2013.01); *E05B 2047/0073* (2013.01)

(58) Field of Classification Search

CPC ..... E05B 37/0034; E05B 1/0007; E05B 37/0072; E05B 47/0038; E05B 47/0607; E05B 47/0603; E05B 47/0615; E05B 47/068; E05B 47/0657; E05B 47/0673; E05B 9/04; E05B 15/0033; E05B 2047/0073; E05C 1/002

USPC ..... 70/284, 285, 224, 445, 278.1, 276, 277; 292/357–359, DIG. 24, DIG. 27, DIG. 63

See application file for complete search history.

(56) References Cited

U.S. PATENT DOCUMENTS

| | | | | | |
|---|---|---|---|---|---|
| D231,316 | S | * | 4/1974 | Bienkowski | D8/312 |
| 4,900,073 | A | * | 2/1990 | Doolan | E05B 63/16 292/169.22 |
| 4,979,383 | A | * | 12/1990 | Tully | E05B 47/0607 70/107 |
| D326,899 | S | * | 6/1992 | Haug | D23/250 |
| D444,695 | S | * | 7/2001 | Decosse | D8/310 |
| D511,290 | S | * | 11/2005 | Coudurier | D8/310 |
| D545,663 | S | * | 7/2007 | Sato | D8/310 |
| D564,332 | S | * | 3/2008 | McConnell | D8/310 |

(Continued)

*Primary Examiner* — Suzanne L Barrett
(74) *Attorney, Agent, or Firm* — Ira Stickler, Esq.

(57) ABSTRACT

A locking system for a door, including a primary locking mechanism and a secondary locking mechanism, in which the primary locking mechanism includes an electrical actuator that causes a first plate and a second plate to be magnetically attracted to one another when actuated such that rotation of a doorknob effects a corresponding rotation of the spindle, and in which the secondary locking mechanism includes a detent that is formed in a knob collar and an aperture that extends through a rotator collar; and a pin that is translatable through the aperture to be disposed in the detent of the knob collar, when the secondary locking mechanism is in an unlocked condition, such that the knob collar and the rotator collar are rotatably fixed to one another.

13 Claims, 24 Drawing Sheets

(56) References Cited

U.S. PATENT DOCUMENTS

| | | | | | |
|---|---|---|---|---|---|
| D565,927 | S | * | 4/2008 | Krumpe | D8/310 |
| D589,776 | S | * | 4/2009 | Camp | D8/310 |
| D618,081 | S | * | 6/2010 | Moyer | D8/331 |
| D787,297 | S | * | 5/2017 | Zimmer | D8/310 |
| 2005/0050928 | A1 | * | 3/2005 | Frolov | E05B 47/068 70/278.3 |
| 2007/0163075 | A1 | * | 7/2007 | Butler | A47L 9/04 15/410 |
| 2014/0041422 | A1 | * | 2/2014 | Chiou | E05B 49/00 70/278.1 |
| 2015/0059424 | A1 | * | 3/2015 | Hunt | E05B 85/107 70/262 |
| 2016/0060903 | A1 | * | 3/2016 | Russo | E05B 35/00 70/263 |
| 2016/0251876 | A1 | * | 9/2016 | Carlsson | E05B 47/0665 70/445 |
| 2019/0136581 | A1 | * | 5/2019 | Barker | E05B 63/0056 |
| 2019/0390478 | A1 | * | 12/2019 | Xiang | E05B 15/04 |
| 2020/0392758 | A1 | * | 12/2020 | Elsmark | H01F 7/1615 |
| 2021/0032900 | A1 | * | 2/2021 | Laporta | E05B 13/005 |
| 2021/0222465 | A1 | * | 7/2021 | Cheng | E05B 15/02 |

* cited by examiner

DOOR LOCKING SYSTEM

CROSS-REFERENCE TO RELATED APPLICATIONS

The present disclosure relates to and claims the benefit or and priority to U.S. Prov. Pat. App. Ser. No. 62/689,066, which was filed on Jun. 23, 2018, the entire contents of which are hereby incorporated by reference.

BACKGROUND OF THE INVENTION

Field of the Invention

The present disclosure generally relates to a door locking system, and more particularly to a door locking system having a doorknob that facilitates improved grasping and/or one-handed operation of the doorknob including, for example, locking or unlocking an associated locking mechanism and rotating the doorknob with a single hand.

Description of the Related Art

Conventionally, an opening/closing mechanism for a door may include a doorknob or handle that is secured to the door such that operation of the doorknob or handle, e.g., rotation of the doorknob or handle, may effect opening of the door. In addition, the doorknob or handle, various locks that may be positioned in a separate location from the doorknob, may be coupled to the door and operated separately to effect locking/or unlocking of such locks.

As shown in FIG. 1, a doorknob K is shown operably coupled to a door D. Rotation of the doorknob in clockwise direction X effects retraction of a deadlocking plunger B configured to releasably engage a strike box (not shown) on the doorsill (not shown) such that the door D may be opened. Some knobs may include a locking mechanism (as in FIG. 2 that is coaxial with a spindle for effecting movement of the deadlocking plunger B) or a keypad P disposed on a proximal face of the knob, which may be alphanumeric, thereon for unlocking and permitting rotation of the knob K in direction X. The knob K has a length L and a width W.

As hands come in a variety of sizes, gripping a knob, especially one that is smooth, while simultaneously attempting to key in a passcode into the keypad P to unlock the lock when the doorknob is bulky. In particular, a user's hand may grasp the entire length L of the doorknob K, thereby making actions such as entering a passcode into a keypad P or operating another lock and/or rotating the doorknob K and/or opening of the door D itself (i.e., pulling the door open) may be difficult. In particular, due to the dimensions including the length of the doorknob K, the user's hand H including his thumb T may be needed to manipulate and grasp the doorknob K and it may not be comfortable to move the thumb T to a position for pressing buttons N of the keypad P. Some locking mechanisms may be timed to remain in an unlocked condition for a short duration of time after unlocking. For some users, the time period may be too short to enter the passcode and then reposition the hand to better manipulate the doorknob K for turning the doorknob K and/or pulling the door D open. In addition, when the only spot to grip the doorknob K is at the end of the length L of the doorknob K, there are a limited number of comfortable position for gripping the doorknob K. For a variety of reasons, including space constraints and the ability to single-handedly manipulate the doorknob K and effect rotation of the doorknob K, it is advantageous to have the keypad P on a face of the doorknob K as opposed to on a surface farther away or adjacent to the doorknob K.

As locking mechanisms become increasingly complex and include various electronic components the doorknob K typically includes a housing containing such electronic components. This results in relatively large knobs K that have a relatively large length L and width W as compared to some user's hands. The relatively large size of the knob K makes manipulating the knob K, particularly, when attempting to operate the locking mechanism challenging.

An example of a prior art doorknob that includes a lock is found in U.S. Pat. No. 4,995,249, the contents of which are incorporated herein by reference in its entirety. FIG. 2 illustrates such a doorknob with a lock. Referring to FIG. 2, a door handle assembly 10 is shown in a disassembled state. The door handle assembly 10 is connectable to a spindle assembly 12 mounted in a conventional way on a door 14. The assembly 10 includes a knob 16 or the like, a core retainer sleeve 18, an interchangeable lock core 20, and a trim ring 22. The core retainer sleeve 18 fits inside the hollow portion of the knob 16 and holds the lock core 20 in place. The trim ring 22 is attached to the spindle assembly 12 to cover the rear portion of the knob 16 facing the door 14. Only when the lock is in its unlocked state, can the retractor mechanism (not shown) can be actuated by rotating the door handle assembly 10 about its axis of rotation to retract a latch bolt 24 mounted in an end face of door 14. Conventionally, the spindle is also coaxial with the lock assembly and the doorknob.

A conventional electric lock 200 is shown in FIG. 3 that includes substantially the same doorknob 16 and locking assembly 20 (as shown in FIG. 2) and also includes a keypad P located adjacent to the knob 16 but not on the knob 16 itself. This makes the conventional electric lock that also includes an electric keypad much larger and the keypad also requires means for securing it to the door. Thus, installation is not a simple manner of swapping a conventional doorknob without a keypad with another doorknob by utilizing the same holes in the door. That is, additional holes in the door would have be drilled to also secure the keypad P portion of the lock 200 to the door. In addition, the electric lock 200 works by actuating the conventional locking assembly 20 of the lock 200.

Accordingly, there is a continuing need for new and improved devices for locking an opening a door that combine a conventional manual key for locking/unlocking the device and an electronic input means for locking/unlocking the door.

Aspects and Summary of the Invention

A locking system for a door may include: a doorknob a first plate; a deadlocking plunger; a spindle operably coupled to the deadlocking plunger, the spindle including a second plate; a knob collar that is rotatably fixed relative to the doorknob; a rotator collar that is rotatably fixed relative to the spindle, the knob collar engages the rotator collar such that it is rotatably fixed relative to the rotator collar in an unlocked condition and being rotatable relative to the rotator collar in the locked condition, wherein engagement of the second collar with the first collar is effected via a selectable operation including a primary locking mechanism and a secondary locking mechanism, wherein the primary locking mechanism includes: an electrical actuator that causes the first plate and the second plate to be magnetically attracted to one another when actuated such that rotation of the doorknob effects a corresponding rotation of the spindle; and wherein the secondary locking mechanism includes: a detent that is formed in the knob collar and an aperture that extends through the rotator collar; and a pin that is translatable through the aperture to be disposed in the detent of the knob collar, when the secondary locking mechanism is in an unlocked condition, such that the knob collar and the rotator collar are rotatably fixed to one another.

The doorknob may be generally cylindrical and has a length, and may also include a ring being centrally disposed along the length of the knob, the ring extending outward from a lateral surface of the knob, the ring providing a gripping surface for a user to manipulate the knob. Opposing edges of the ring along a width of the ring may be rounded. The ring may be positioned substantially at a midpoint along the length of the doorknob.

An alphanumeric keypad may be disposed on a proximal face of the doorknob, the alphanumeric keypad being configured to effect actuation of the magnetic force upon entry of a code using the alphanumeric keypad.

A U-shaped bracket may support the pin and may be movable in a first direction toward the second collar and a second direction away from the second collar. A biasing member, e.g., spring, may bias or urge the U-shaped bracket away from the second collar.

In addition to a magnetic locking mechanism, the locking system may include a keyed cylinder that is rotatable in a first direction to effect movement of the U-shaped bracket toward the second collar and that is rotatable in a second direction to effect movement of the U-shaped bracket away from the second collar.

The locking system may also include a power source that when actuated causes the first and second plates to be magnetically attracted to one another. The power source may be housed within the doorknob. The knob collar may include a first detent that is configured to receive a portion of the pin extending through the aperture of the rotator collar. The pin may remain within the first detent in both the unlocked and locked conditions, and wherein in the unlocked condition, the pin extends through an aperture extending through the first detent to contact a lateral surface of the spindle. The pin is biased away from the detent of the knob collar, for example, by a spring that is disposed along the length of the pin. Both the knob collar and the rotator collar may be disposed around the spindle, and wherein the knob collar is freely rotatable about the perimeter of spindle in the locked condition.

These and other aspects of the present disclosure are described in further detail hereinbelow.

BRIEF DESCRIPTION OF THE DRAWINGS

A further understanding of the present disclosure can be obtained by reference to a preferred embodiment set forth in the illustrations of the accompanying drawings. Although the illustrated preferred embodiment is merely exemplary of methods, structures and compositions for carrying out the present disclosure, both the organization and method of the disclosure, in general, together with further objectives and advantages thereof, may be more easily understood by reference to the drawings and the following description. The drawings are not intended to limit the scope of this disclosure, which is set forth with particularity in the claims as appended or as subsequently amended, but merely to clarify and exemplify the disclosure.

For a more complete understanding of the present disclosure, reference is now made to the following drawings in which.

DETAILED DESCRIPTION OF THE PREFERRED EMBODIMENTS

Figure 1:
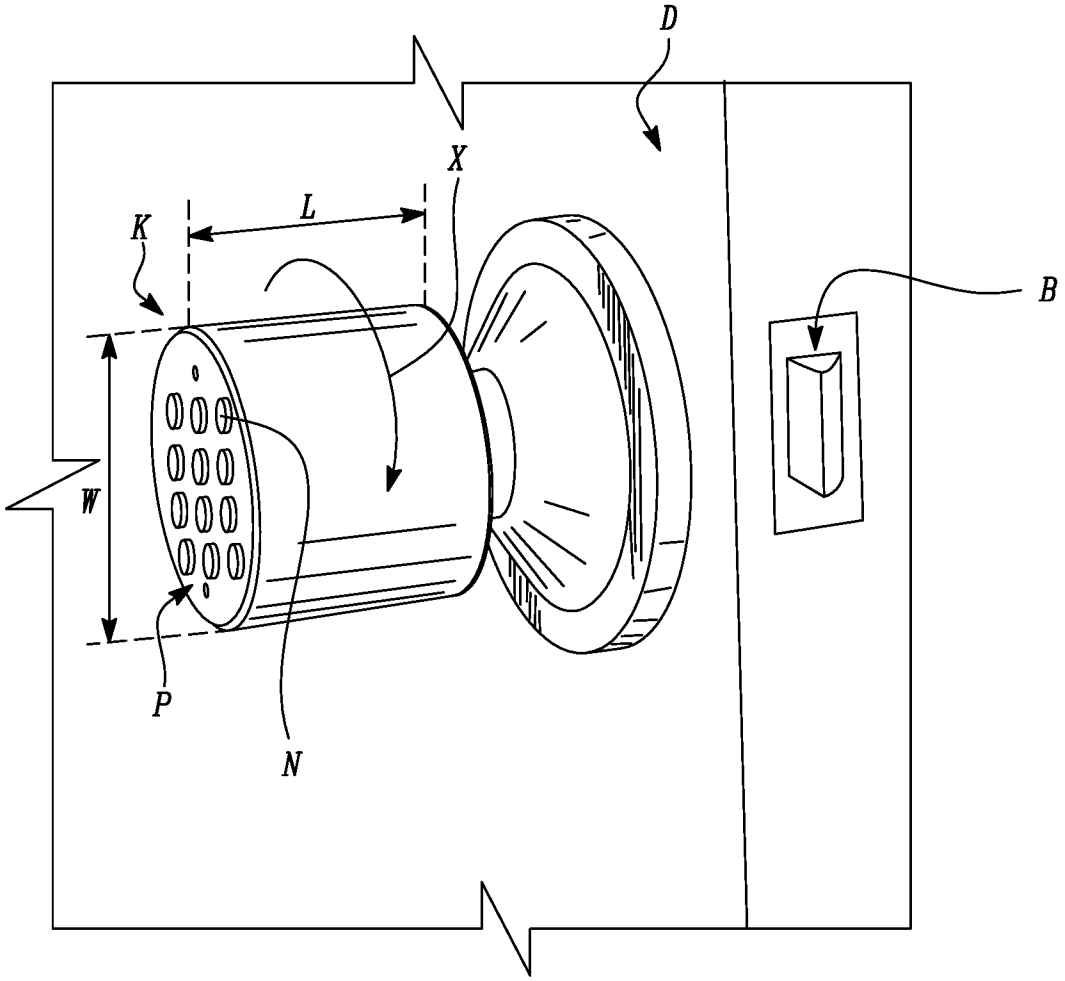
PRIOR ART FIG. 1
FIG. 1 is a perspective view of a prior art doorknob and electric locking mechanism.
Figure 2:
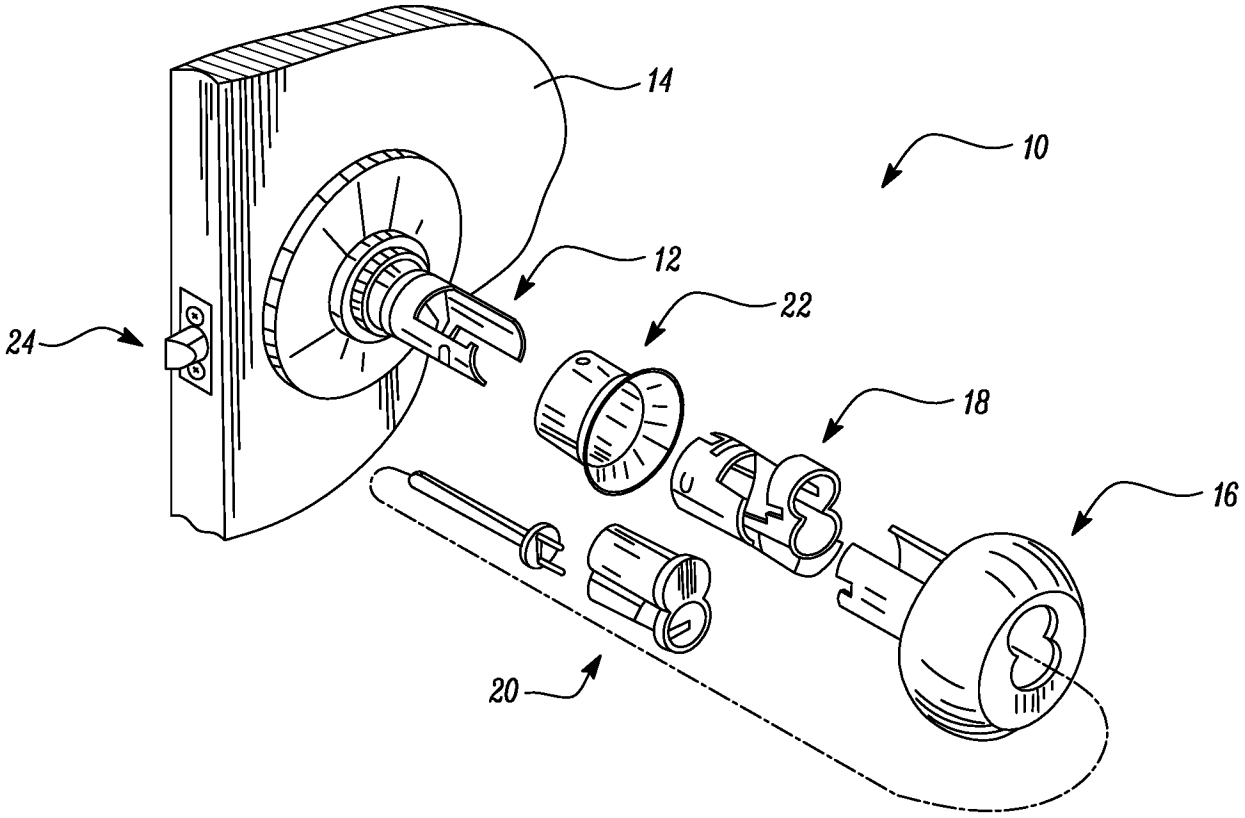
PRIOR ART FIG. 2
FIG. 2 is an exploded view of a prior art doorknob and mechanical and manually operated locking mechanism.
Figure 3:
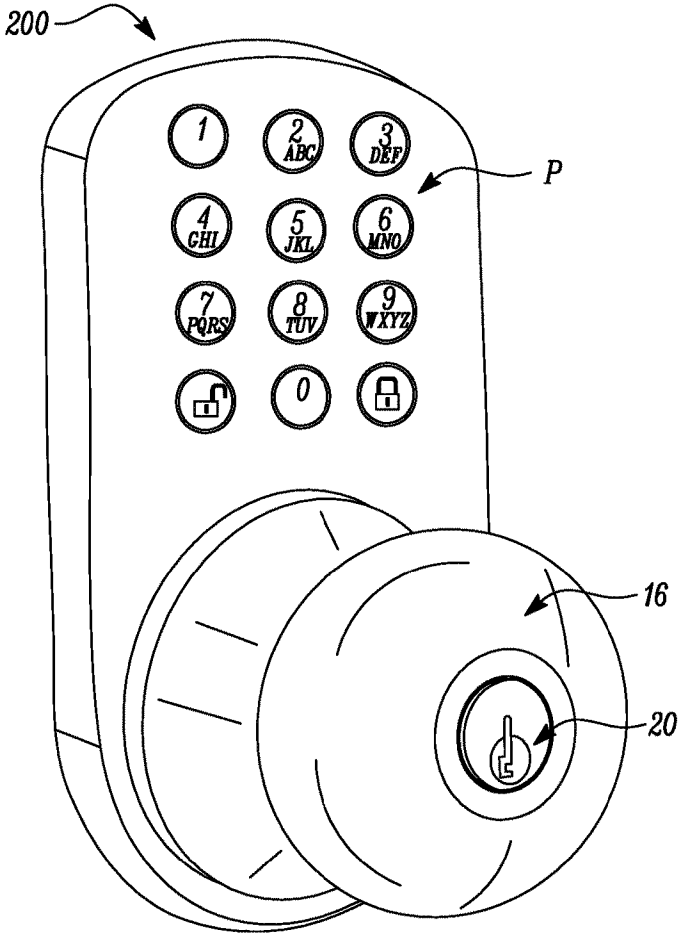
FIG. 3 PRIOR ART
FIG. 3 is a perspective view of a prior art doorknob and combination electric and manually operated locking mechanism.

Reference will now be made in detail to embodiments of the invention. Wherever possible, same or similar reference numerals are used in the drawings and the description to refer to the same or like parts or steps. The drawings are in simplified form and are not to precise scale.

Figure 4:
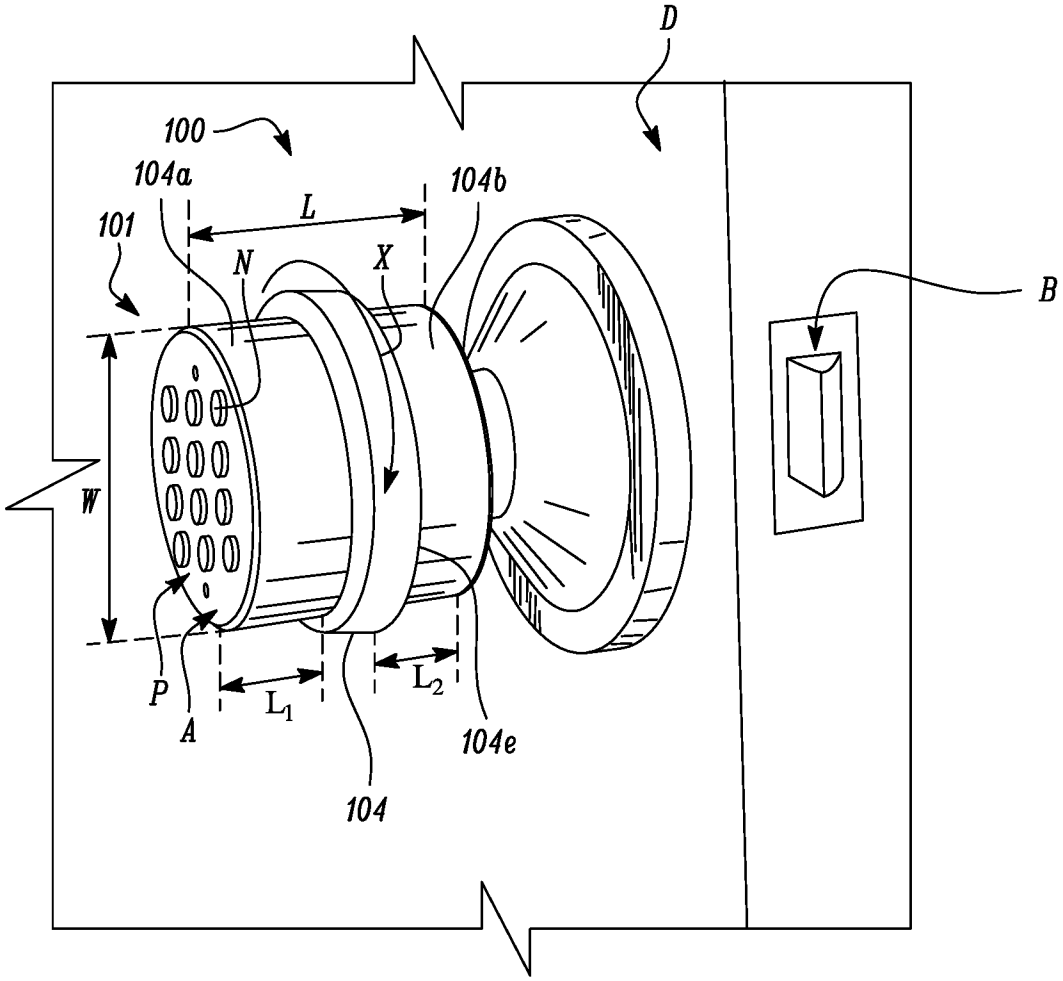
FIG. 4 is a perspective view of a doorknob in accordance with the present disclosure.
Figure 5:
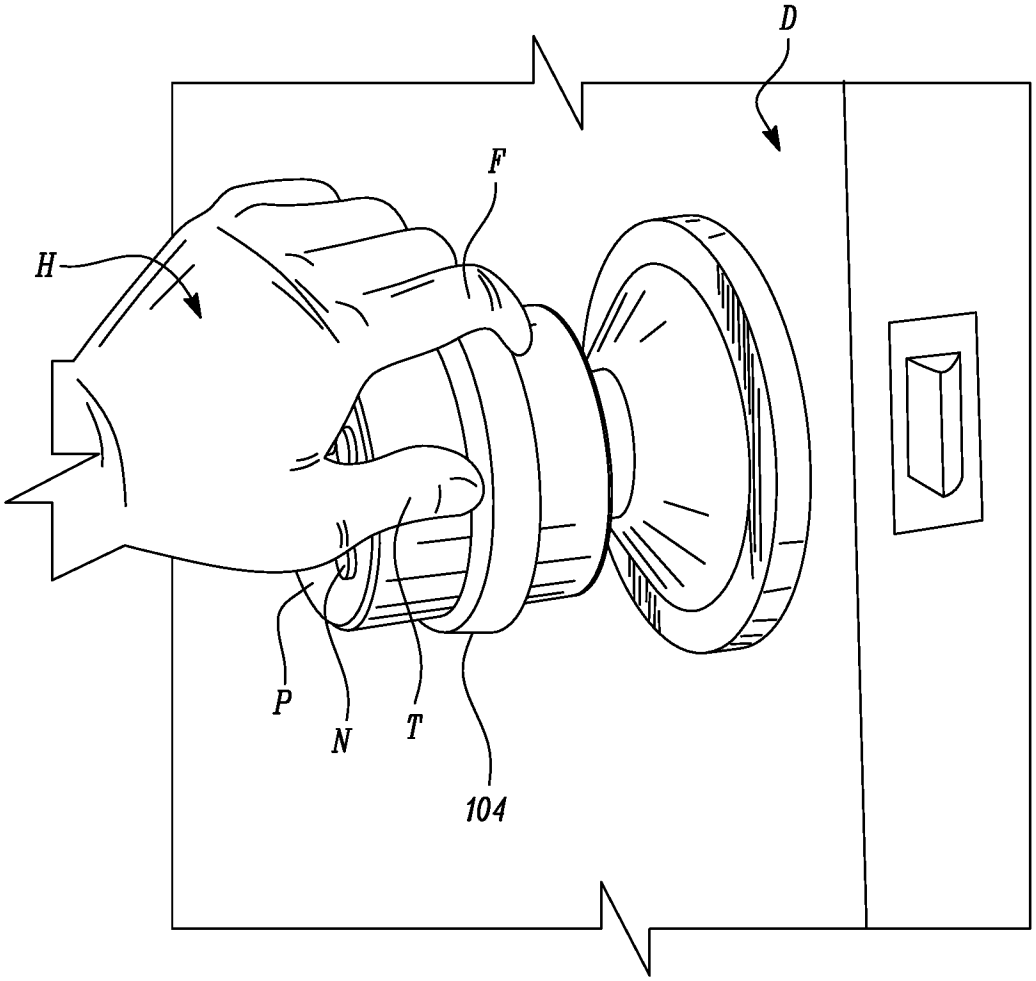
FIG. 5 is a perspective view of the doorknob of FIG. 4 shown in use.

As shown in FIGS. 4 and 5, a doorknob apparatus 100 may be configured to be operably coupled to a door D to effect control of the deadlocking plunger. The doorknob 100 is similar to the doorknob K except that it includes an ergonomic knob 101 for facilitating grasping of the knob K and operation thereof.

The knob 101 may have a generally cylindrical shape and may include a gripping surface or ring 104 disposed along the length L of the knob 101 on a lateral surface thereof. The gripping surface 104 may outwardly extend from a lateral surface of the doorknob 101 and may be substantially disposed at a central point along the length L, thereby dividing the length of the knob 101 into a first section 104*a* that is proximal to the user during use and a second section 104*b* that is distal to the user during use. The first section 104*a* may have a first length L1 and the second section 104*b* may have a second length L2. The first and second lengths L1 and L2 may be substantially the same or they may be different. The gripping surface 104 may extend outward from the lateral surface of the doorknob 101 by a distance that provides a sufficient gripping surface for the user's fingers F such that the doorknob 101 may be more easily manipulating without fully grasping the entire doorknob 101 in the user's hand.

For example, as in FIGS. 4-5, the distance that the gripping surface 104 protrudes may be commensurate with the length of a typical user's first finger joint, that is the length of a distal phalanx of a finger. Since the fingers F may grip the gripping surface 104 which is spaced by the distance L2 from the distal end of the knob 101, the thumb T is free to move to move with greater ease at the proximal end A of the knob 101 such that the keypad P may be manipulated and the buttons N pressed at any location along the width of the doorknob 101 at the proximal end A thereof.

Figure 6:
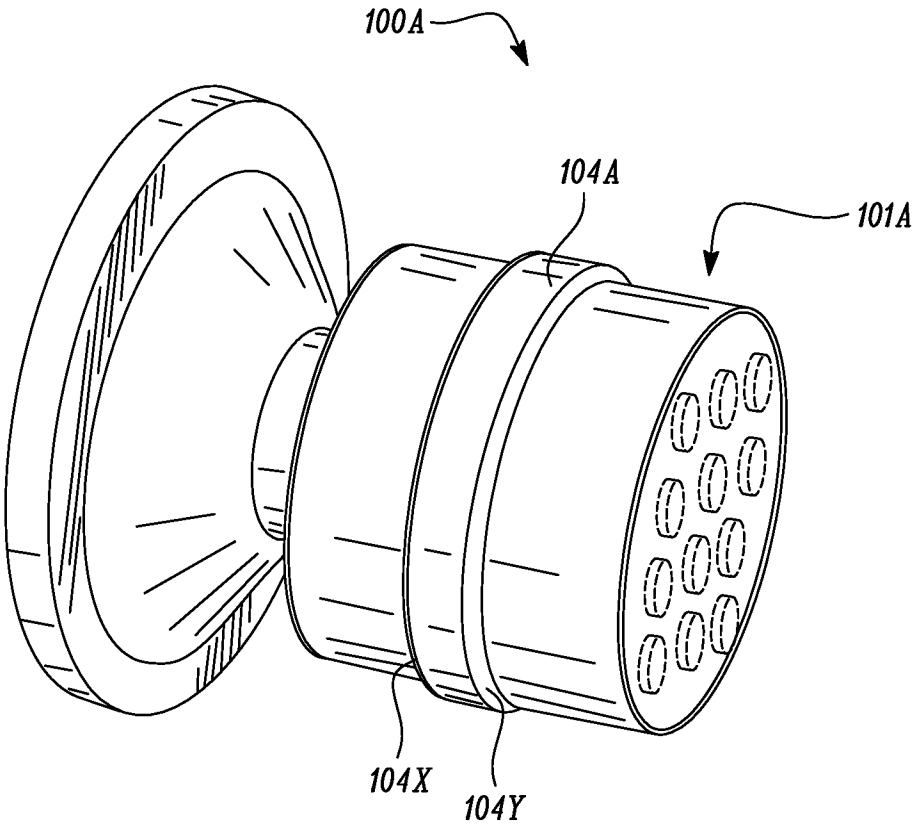
FIG. 6 is a perspective view of another doorknob in accordance with the present disclosure.

As shown in FIG. 6, another embodiment of a doorknob apparatus 101A is shown. The doorknob apparatus 101A is substantially similar to the doorknob apparatus 101 except that opposing edges 104X and 104Y of the gripping surface or ring 104A may be smooth or rounded such that the surfaces are not sharp, thereby inhibiting any potential injury.

locking system 300 in accordance with the present disclosure is described with reference to FIGS. 7-19.

Advantageously, the locking system 300 provides both a keyed locking mechanism and a keypad mechanism for locking and unlocking the locking system 300 while being able to utilize the same pre-drilled hole in the door through which a prior conventional doorknob may have previously been installed. For example, a backplate 301*p* of the housing 300 and an inside knob 302B may sandwich the doorframe D therebetween and may be held in place by friction without requiring any additional drilling or securing of the system 300.

As shown in FIGS. 7-10, the locking system 300 may include a housing 301 that may include a backplate for contacting a door D and for supporting a knob 302A while also housing a locking mechanism including a keyed cylinder 309. The keyed cylinder 309 is configured to receive a key 305 and when rotated within an aperture 301*a* of the housing 301 to effect locking when rotated in a first direction and to effect unlocking when rotated in a second direction opposite that of the first direction. Rotation of the keyed cylinder 309 is provides but one means to effect locking and unlocking of the system 300. Another and independent means to effect locking and unlocking of the system 300 is effected when a numerical or alphanumeric code is keyed into a keypad on a front face of the knob 302A which includes a keypad 302*k* which may include numerical digits 09, as well as an asterisk (*) and a hash or pound symbol (#). Unlike the conventional art, the locking system 300 may be locked/unlocked via either the keyed cylinder 309 or the keypad 302*k* as each has an independent mechanism for effecting locking/unlocking. That is, the keypad 302*k* does not effect rotation of the cylinder 309 or its constituent parts which may remain in the locked condition as rotation of the spindle and the corresponding movement of the deadlocking plunger B are effected through independent means. While the locking system 300 may include an internal power source, e.g., a battery, an electrical plug 306*e* may be included on one of the knobs, e.g., the exterior knob 302A for plugging an electrical source to the electrical plug 306*e* in the event that the internal power source of the system 300 has died.

Figure 7:
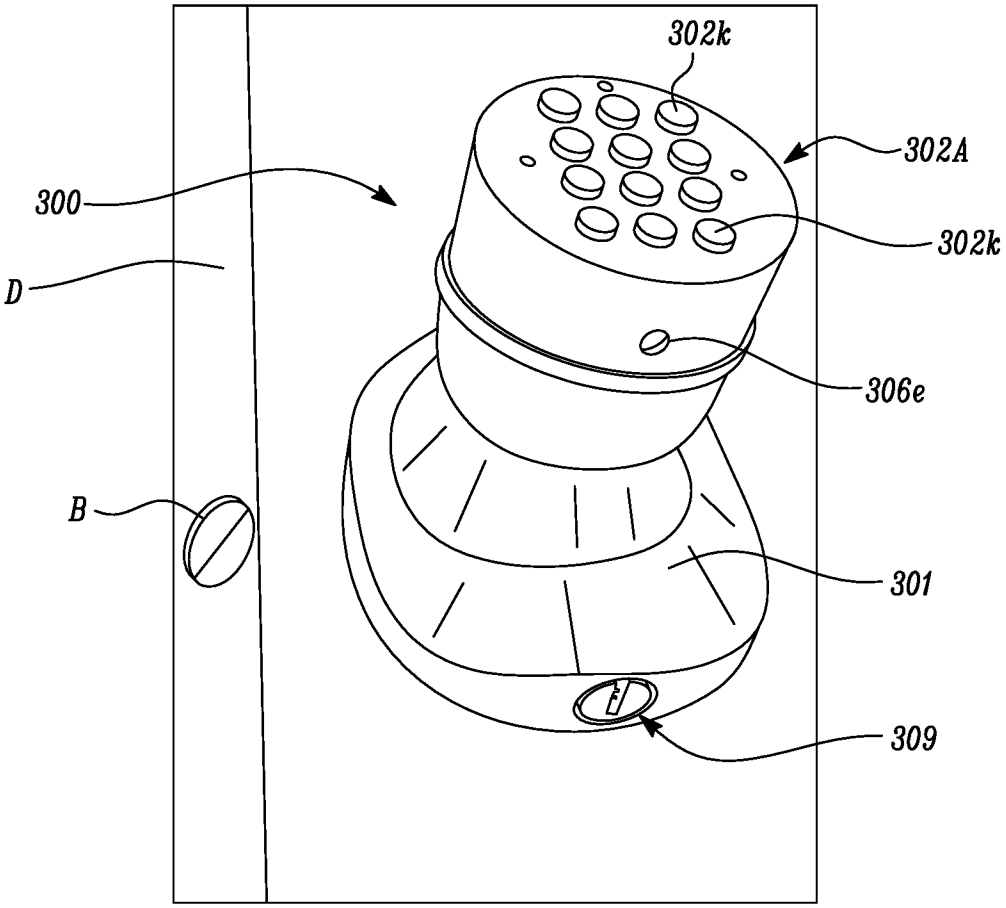
FIG. 7 is a perspective view of a portion of a doorknob and combination electric and manually operated locking system in accordance with the present disclosure shown installed within a door.
Figure 7A:
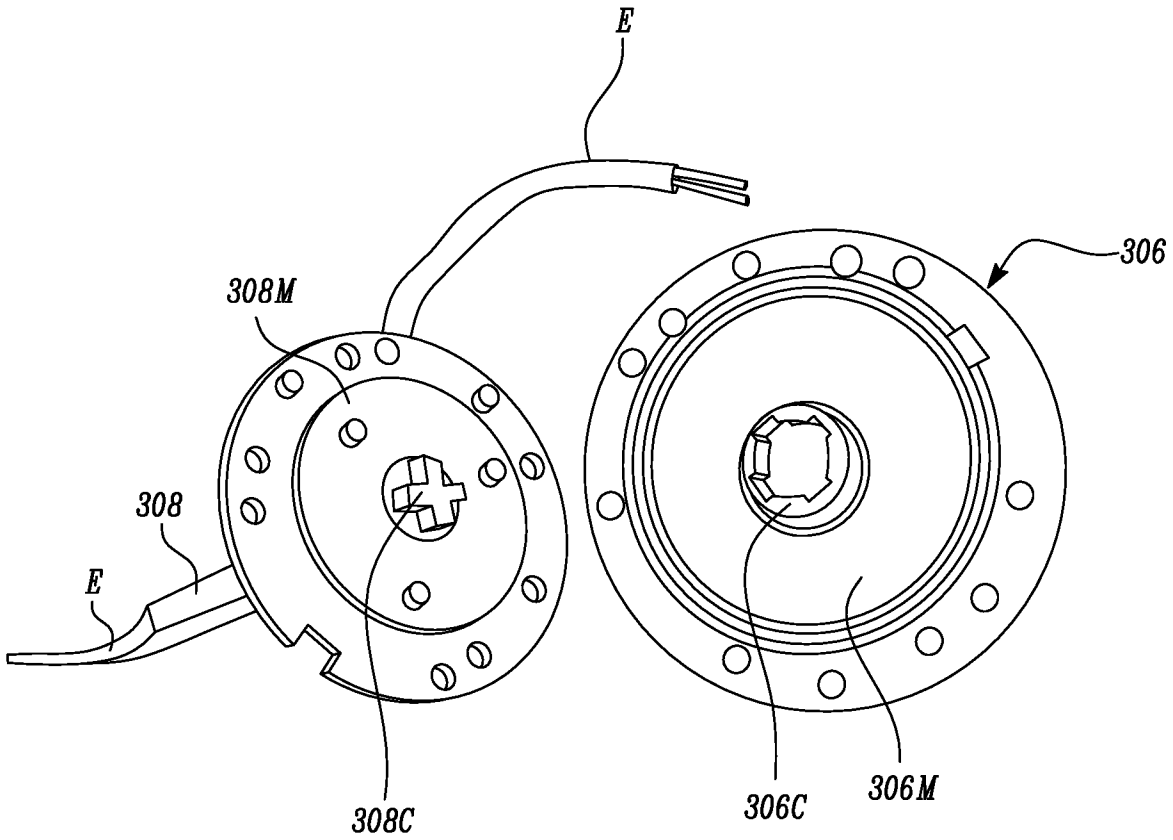
FIG. 7A is a perspective view of a portion of the doorknob and combination electric and manually operated locking system of FIG. 7 shown with parts separated.
Figure 7B:
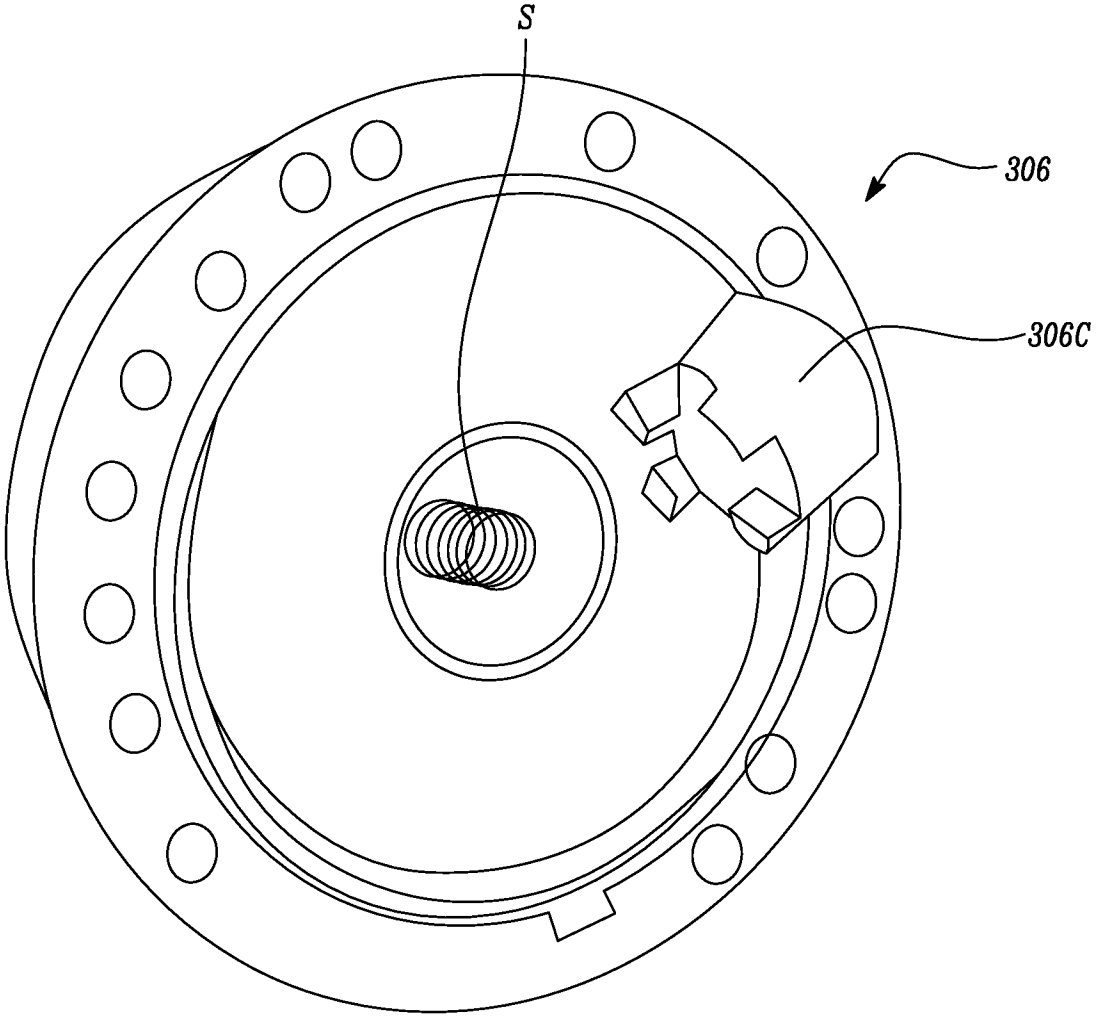
FIG. 7B is a perspective view of a portion of the doorknob and combination electric and manually operated locking system of FIG. 7 shown with parts separated.
Figure 8:
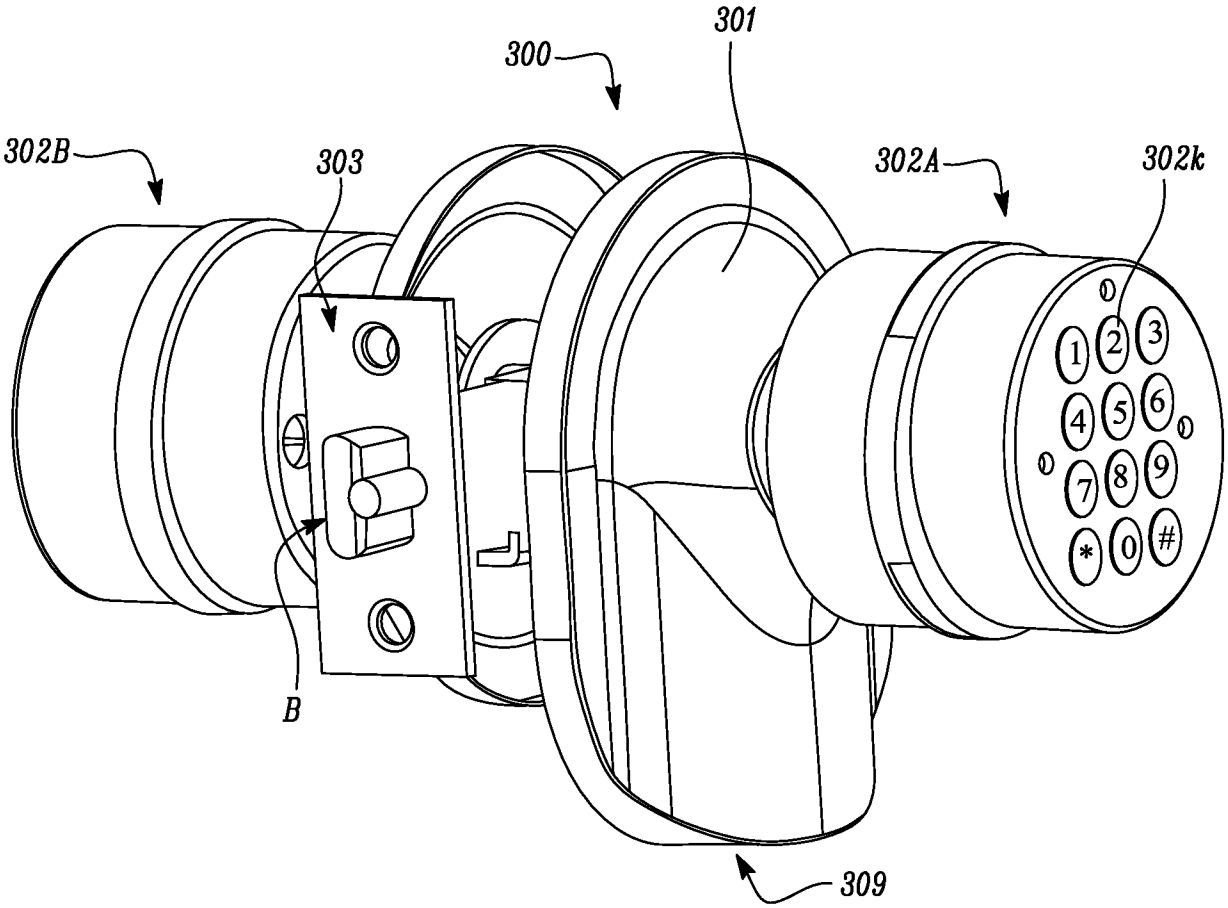
FIG. 8 is a perspective view of the locking system of FIG. 7.
Figure 9:
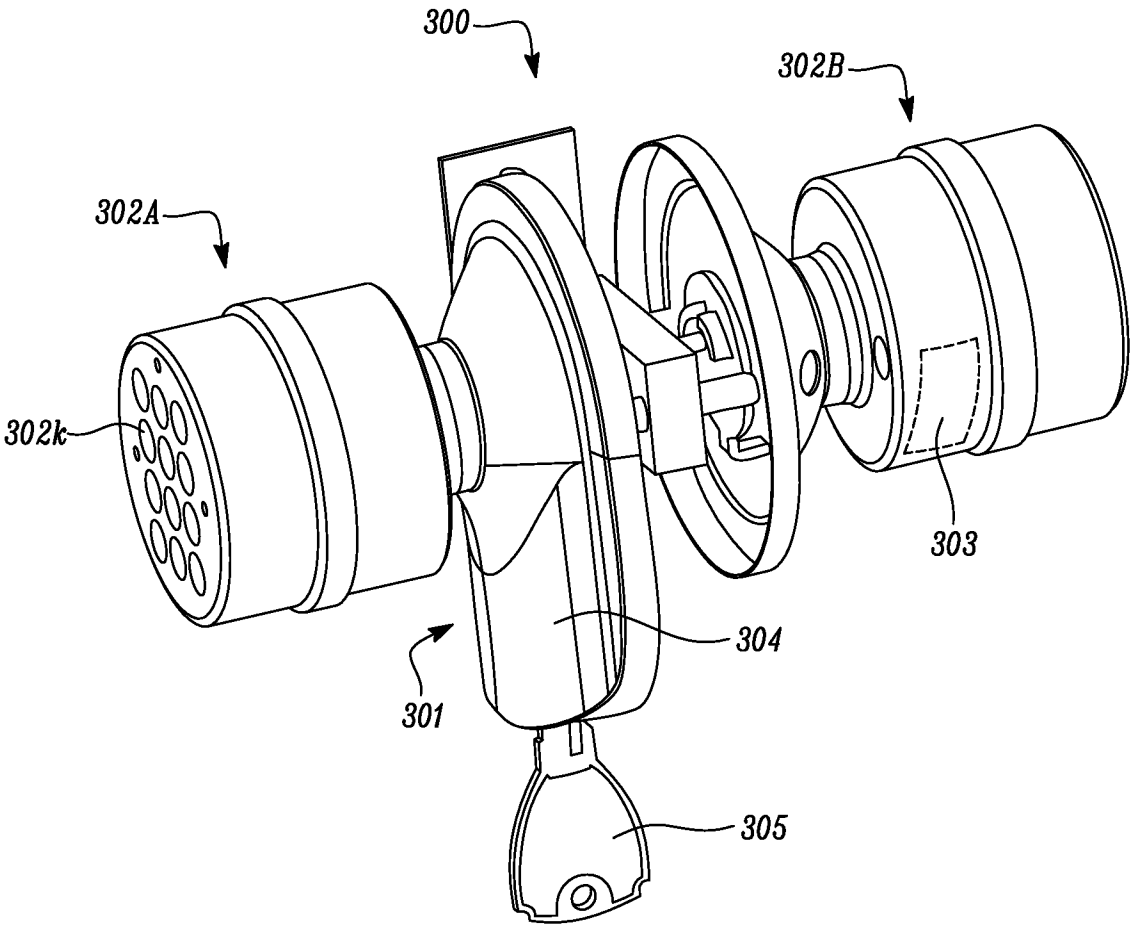
FIG. 9 is a perspective view of the locking system of FIG. 7 shown in an unlocked condition.

When in the locked condition, the exterior knob 302A may not be engaged with the spindle 308 such that rotation of the exterior knob 302A would not cause a corresponding rotation of the spindle 308 and the deadlocking plunger B will not open. Conversely, when in the unlocked condition, the exterior knob 302A is engaged with the spindle 308. As shown in FIGS. 7A-7B, a magnetic locking mechanism is shown in which the spindle 308 includes a plate 308M which may include a magnetic or ferrous material and a male member 308C which may form a cruciform shape. The exterior knob 302A may include a plate 306M which may be formed from a magnetic or ferrous material and may include a female mating part 306C. When the male member 308C and the female mating part 306C engage one another, the knob 306 may control rotation of the spindle 308; whereas when not engaged, rotation of the knob 306 may not effect rotation of the spindle 308. After entering a correct code using the keys 302*k*, an electrical current may cause the plates 308M and 306M to become magnetically attracted to one another such that the male member 308C is inserted into the corresponding female mating part 306C and rotation of the knob 306 will effect a corresponding rotation of the spindle 308. Electrical wiring E may run through the length of the spindle 308 to electrically couple the keypad 302*k* with a power source that may be housed within the interior knob 302B.

As shown best in FIGS. 9-12B, the locking system 300 may include both the magnetic locking mechanism discussed above and a keyed locking mechanism. In particular, the locking system 300 may include a rotator collar 312 that is secured to the spindle 308 such that rotation of the rotator collar 312 effects a corresponding rotation of the spindle 308. A knob collar 314 may be coupled to the exterior knob 302A such that rotation of the exterior knob 302A effects rotation of the knob collar 314. In the assembled condition, the knob collar 314 is disposed within the rotator collar 312. In the locked condition, the knob collar 314 and the rotator collar 312 freely rotate with respect to one another; however, in the unlocked condition, the knob collar 314 and the rotator collar 312 are fixed to one another and rotate in unison.

Figure 10:
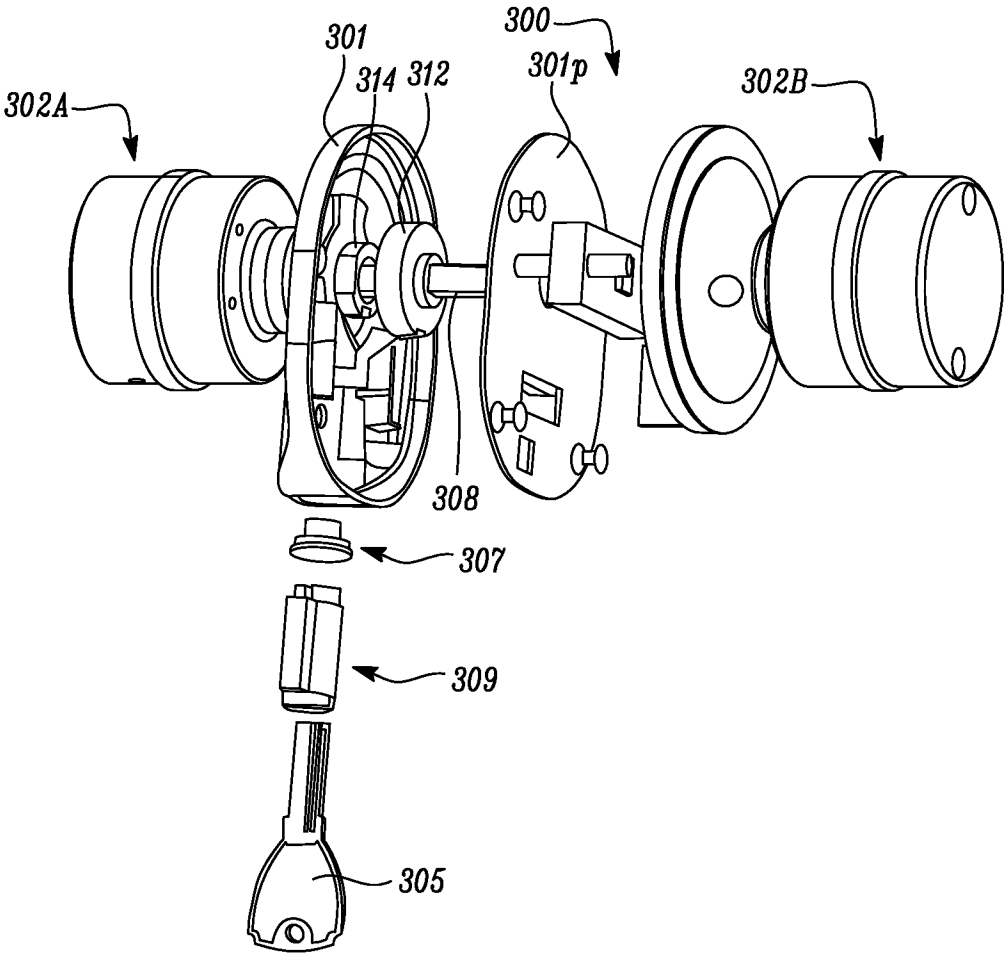
FIG. 10 is a perspective and partially exploded view of the locking system of FIG. 7.
Figure 10A:
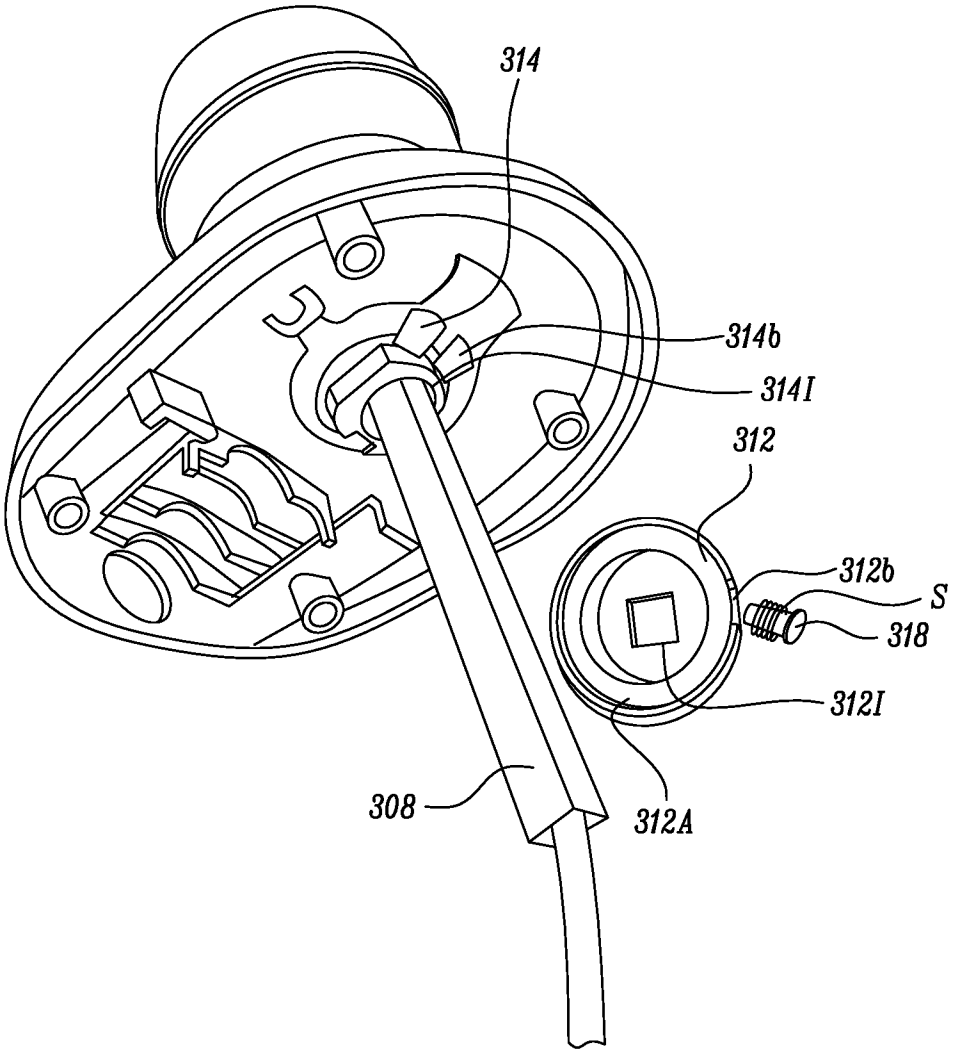
FIG. 10A-10B are perspective views of portions of the locking system of FIG. 7 shown with parts separated.
Figure 10B:
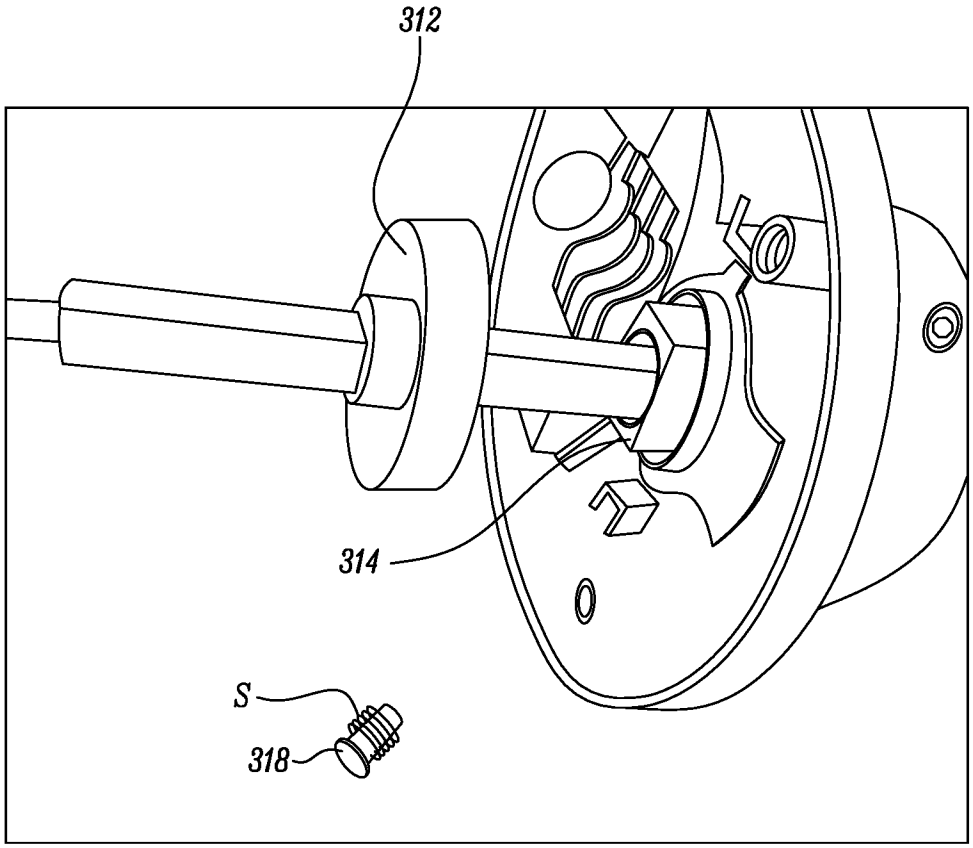

As shown in FIG. 10, the knob collar 314 has an inner configuration 3141 that is disposed about the spindle 308 but does not engage the lateral sides of the spindle 308. For example, the spindle 308 may have a polygonal (e.g., square shape) and the inner configuration 3121 of the rotator collar 312 may have corresponding configuration or shape to the polygonal shape of the spindle 308 such that the two rotate in unison, and the inner configuration 3141 of the knob collar 314 may be circular such that it does not directly engage the spindle 308. When the rotator collar 312 is locked relative to the knob collar 314, rotation of the exterior knob 302A causes the knob collar 314 to rotate and this in turn causes the spindle 308 to rotate.

Figure 10C:
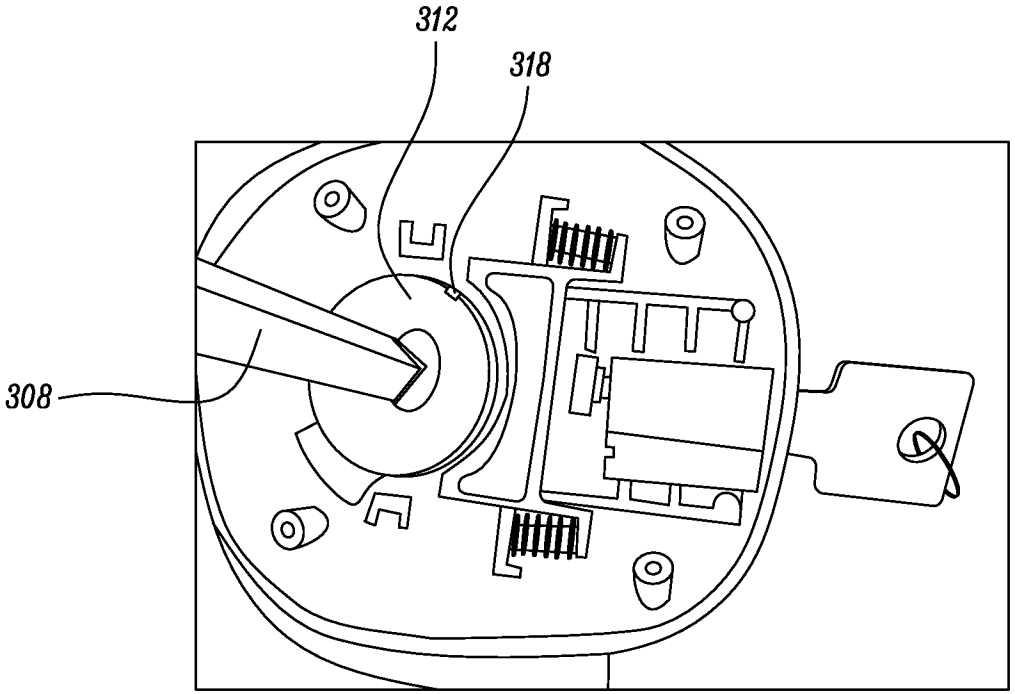
FIG. 10C is a view of a portion of the locking system of FIG. 7 shown in an unlocked condition with the spindle having been rotated.

As shown in FIGS. 10A-11A, the rotator collar 312 has a recess 312A that may receive the knob collar 314 therein. In addition, the rotator collar 312 includes aperture 312*b* through which pin 318 may be received. The pin 318 is configured to engage detent 314*b* of the knob collar 314 such that when the pin 318 passes through the aperture 312*b* and is positioned within the detent 314*b* of the knob collar 314, the collars 312 and 314 rotate in unison with one another. As shown in FIG. 10C, the spindle 308 is shown having been rotated. A spring S may be disposed along a length of the pin 318 and may bias the pin 318 out from the detent 314*b* of the knob collar 314 when the U-shaped bracket 316 is in the locked condition and is spaced farther away from the collar 312 than when in the unlocked condition such that the pin 318 is urged out from the detent 314*b* by the force of the spring S disposed along its length.

Figure 11:
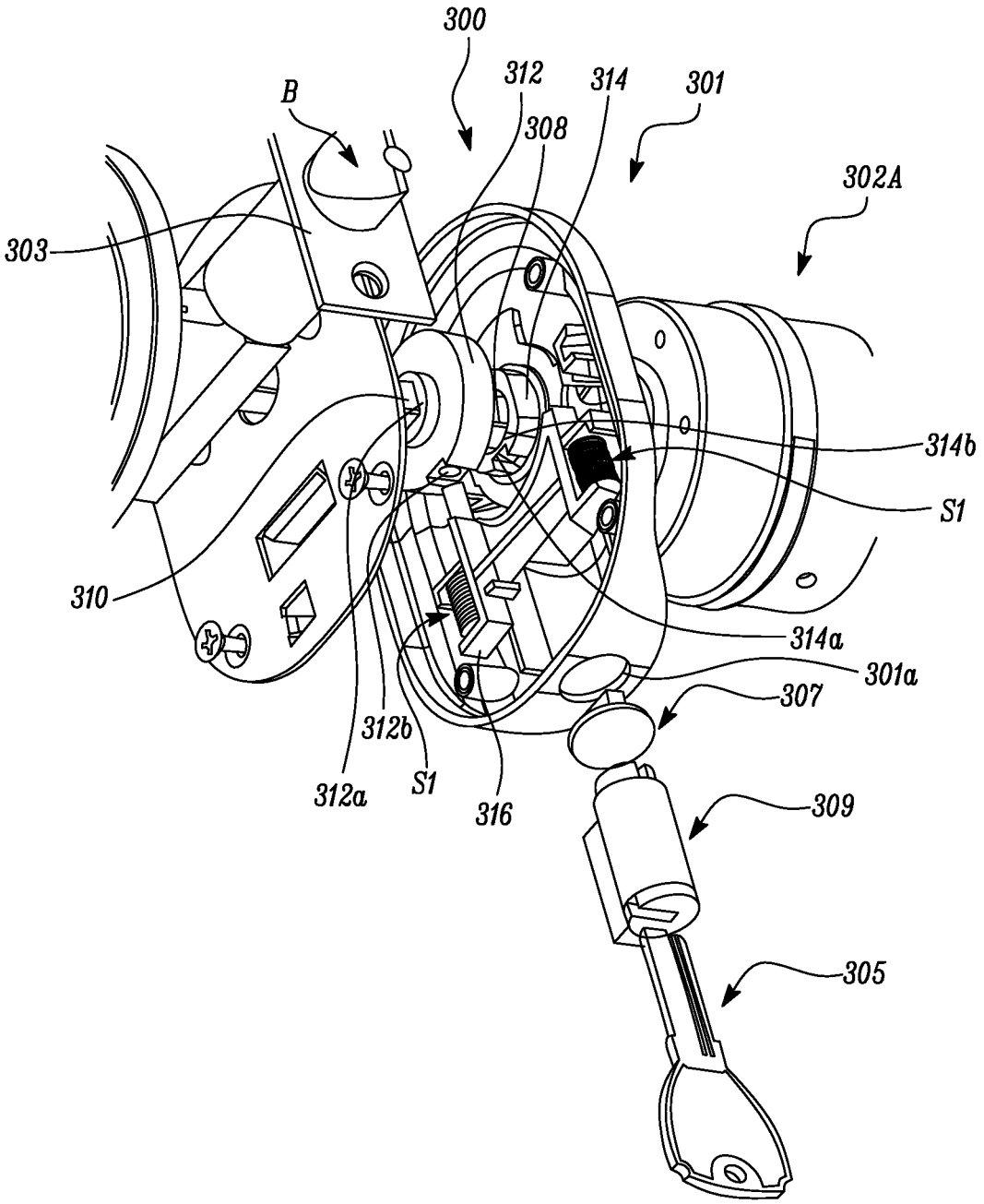
FIG. 11 is a perspective and partially exploded view of the locking system of FIG. 7.
Figure 11A:
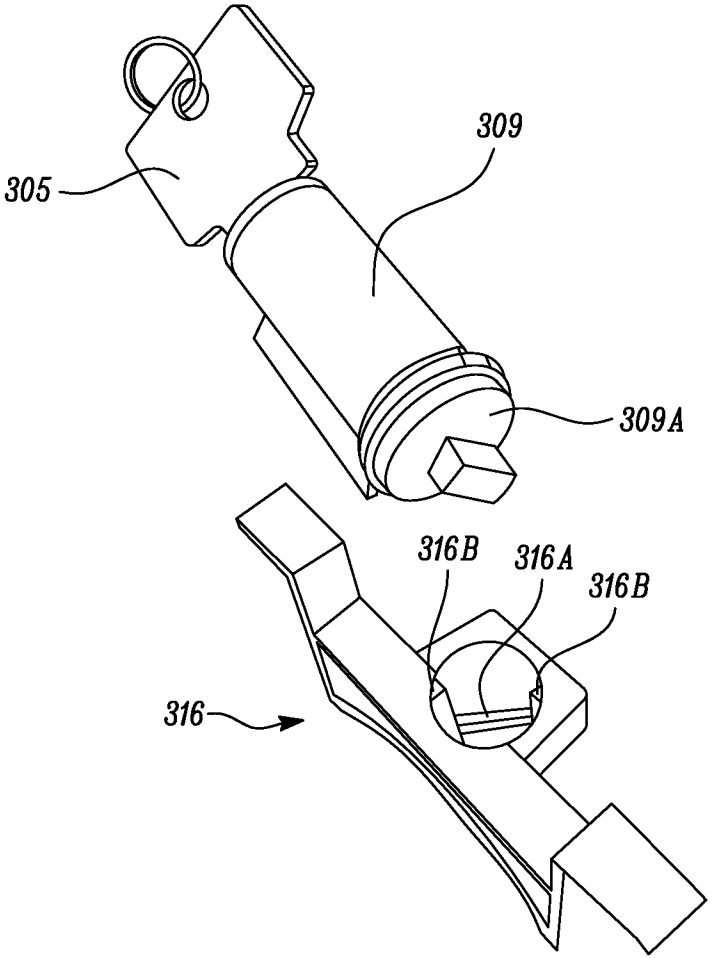
FIG. 11A is a perspective view of a keyed locking cylinder shown relative to a U-bracket.

As shown in FIG. 11A, the cylinder 309 may include a distal section 309A that is rotatable within a space 316A defined within the U-shaped bracket 316. The distal section 309A may have a shape that is configured to interact with protrusions 316B such that rotation of the distal section 309A causes the U-shaped bracket 316 to move away from the distal section 309A when rotated when the distal section 309A presses against the protrusions 316B. As the U-shaped bracket 316 moves toward the collar 314, the pin 318 is pushed through aperture 312*b* and into the detent 314*b* such that the collars 312 and 314 are rotatably secured to one another. This is an unlocked condition as the exterior knob 302A which is rotatably secured relative to the collar 314 is now operably coupled, that is, rotatably secured relative to the collar 312 which is in turn rotatably secured relative to the spindle 308, which means that rotation of the exterior knob 302A effects a corresponding rotation of the spindle 308.

As shown best in FIG. 11, a through-hole 314*b* of the knob collar 314, which is disposed around the spindle 308) is round; whereas the spindle 308 has a polygonal cross-section. Thus, the knob collar 314 can rotate without effecting a corresponding rotation of the spindle 308 as the surfaces of its through-hole 314*b* are not configured to contact the sides of the polygonal spindle 308. In contrast, the collar 312 includes an opening having an inner configuration 3121 that is shaped to engage the lateral surfaces of the spindle 308 such that rotation of the collar 312 causes a corresponding rotation of the spindle 308 as the through-hole 312 closely approximates the lateral surfaces of the spindle 308.

Figure 12B:
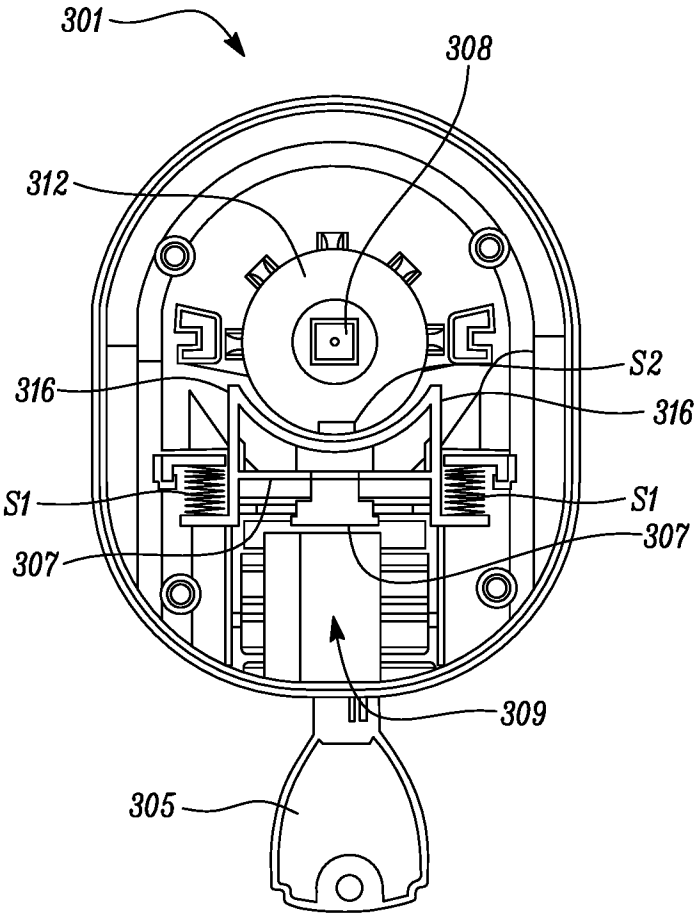
FIG. 12B is a front view of a locking mechanism of the locking system of FIG. 7 shown with parts removed and in a locked condition.
Figure 12A:
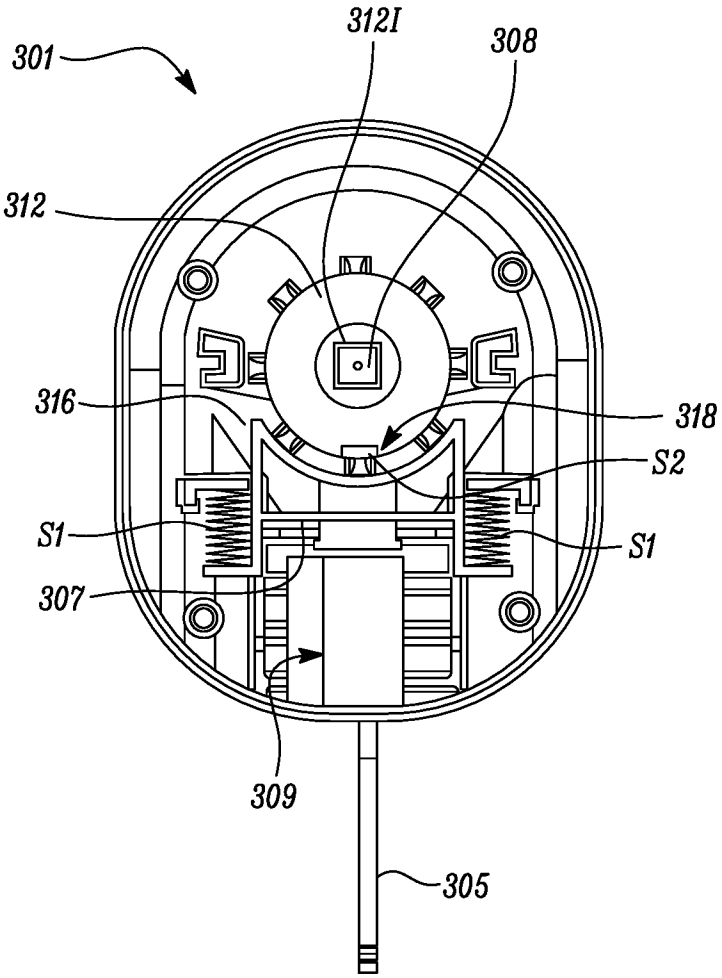
FIG. 12A is a front view of a locking mechanism of the locking system of FIG. 7 shown with parts removed and in an unlocked condition.
Figure 13:
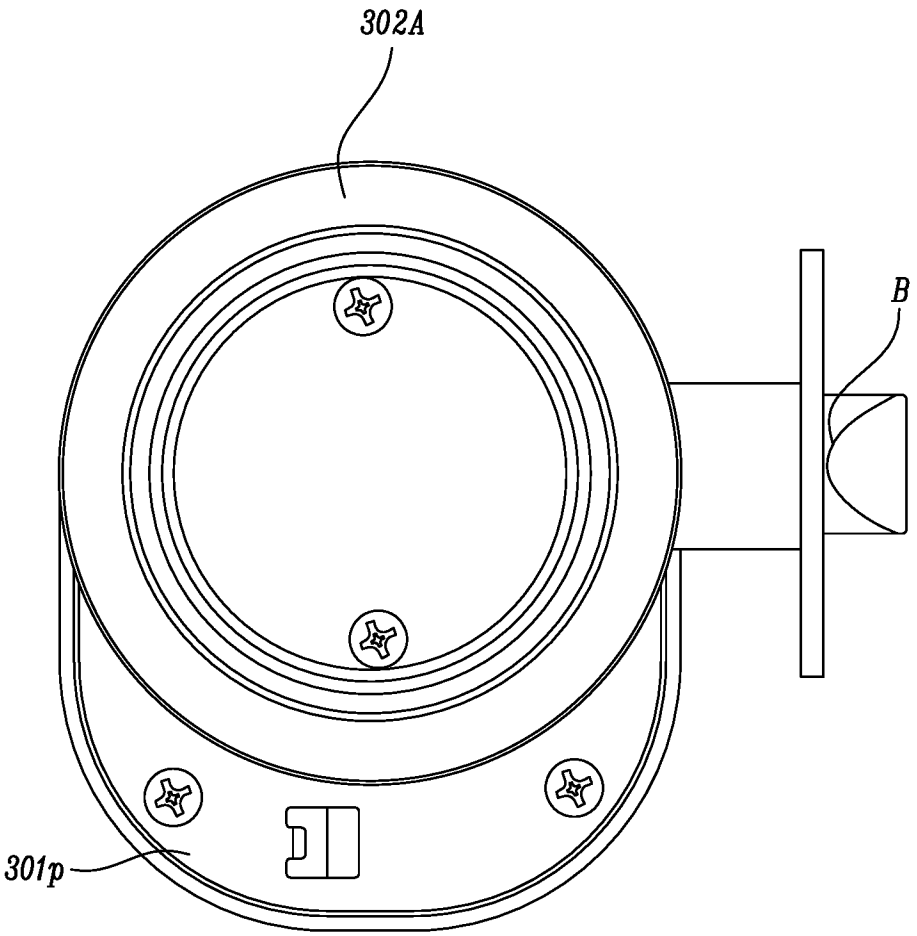
FIG. 13 is a front view of the locking system of FIG. 7 as shown from a first end thereof.
Figure 14:
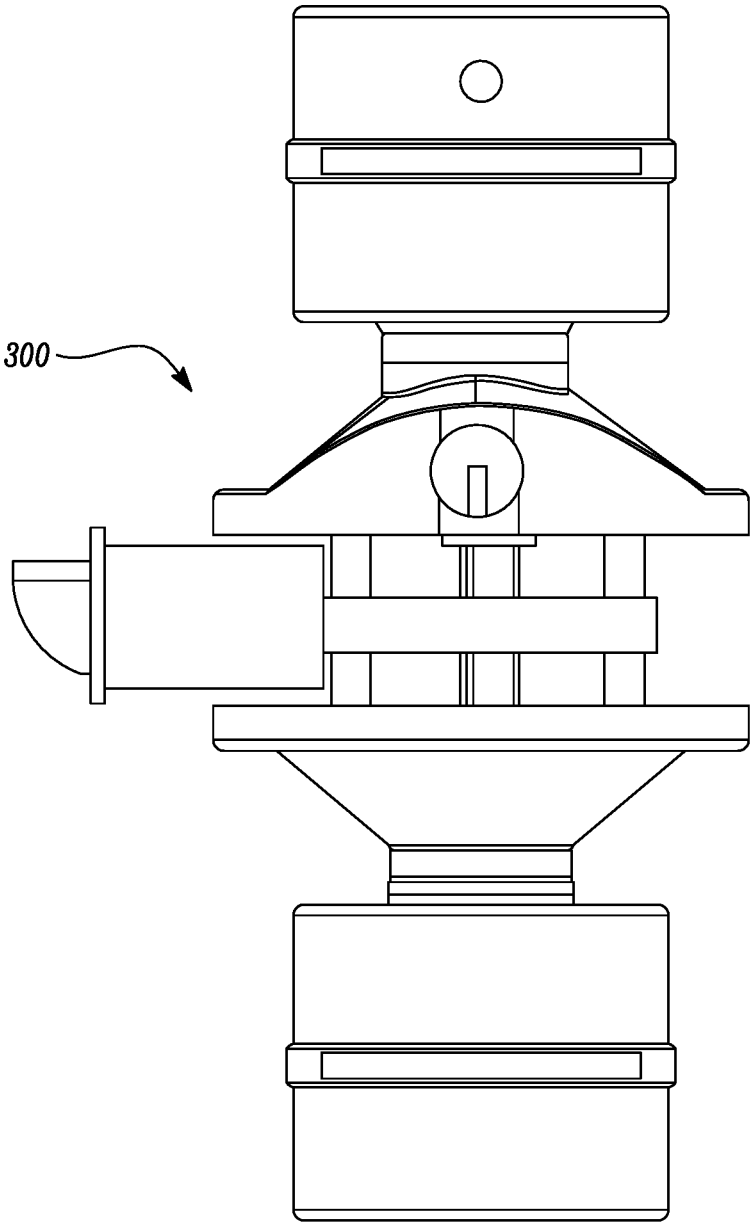
FIG. 14 is a bottom view of the locking system of FIG. 7.
Figure 15:
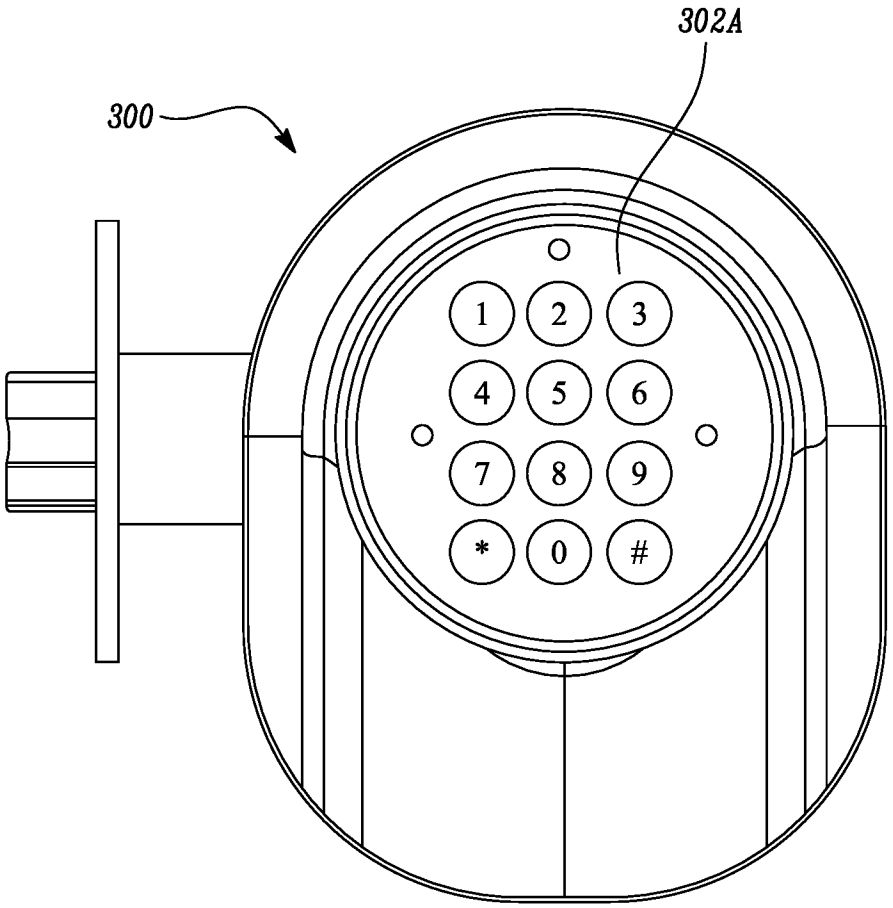
FIG. 15 is a front view of the locking system of FIG. 7 as shown from a second end thereof.
Figure 16:
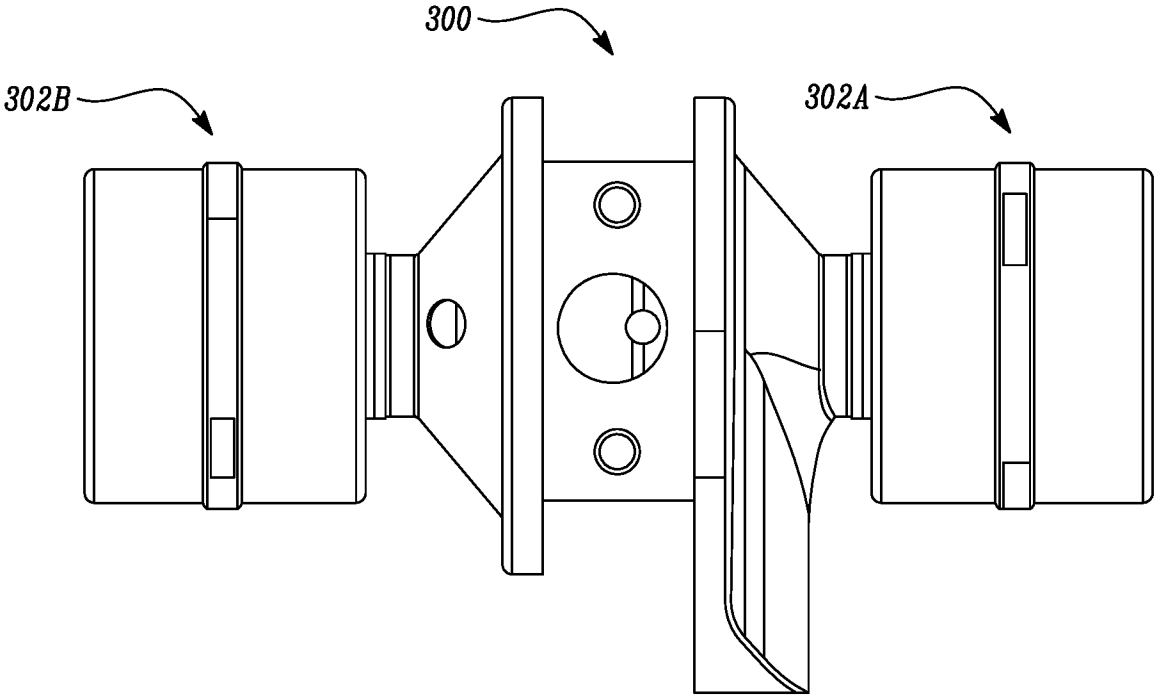
FIG. 16 is a side view of the locking system of FIG. 7.
Figure 17:
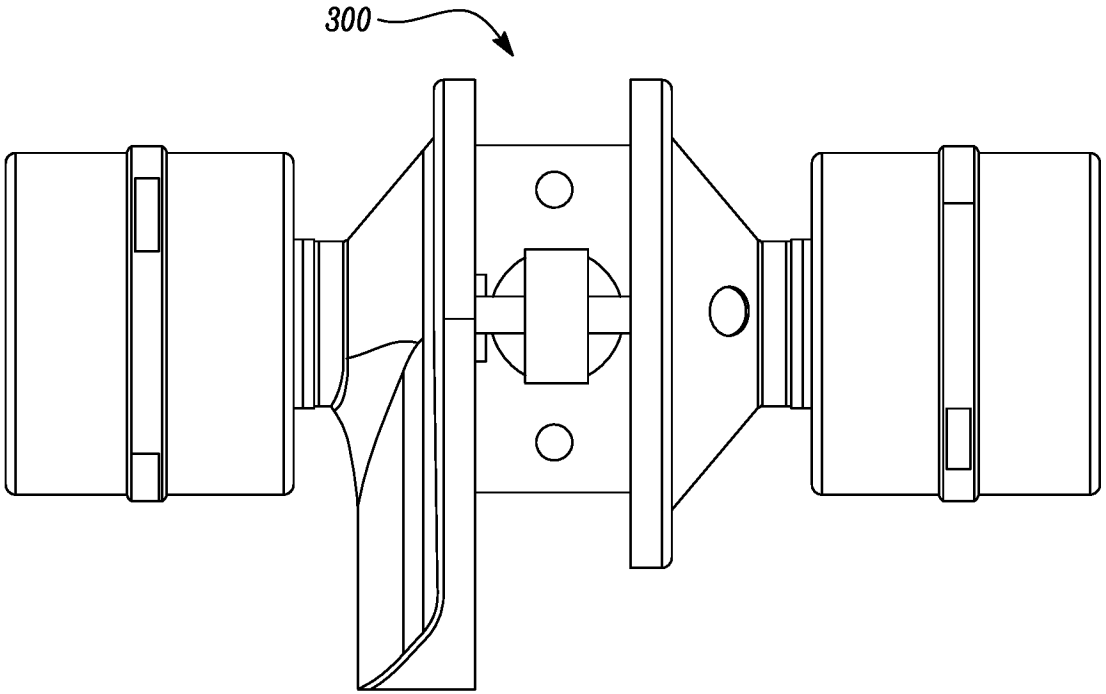
FIG. 17 is another side view of the locking system of FIG. 7.
Figure 18:
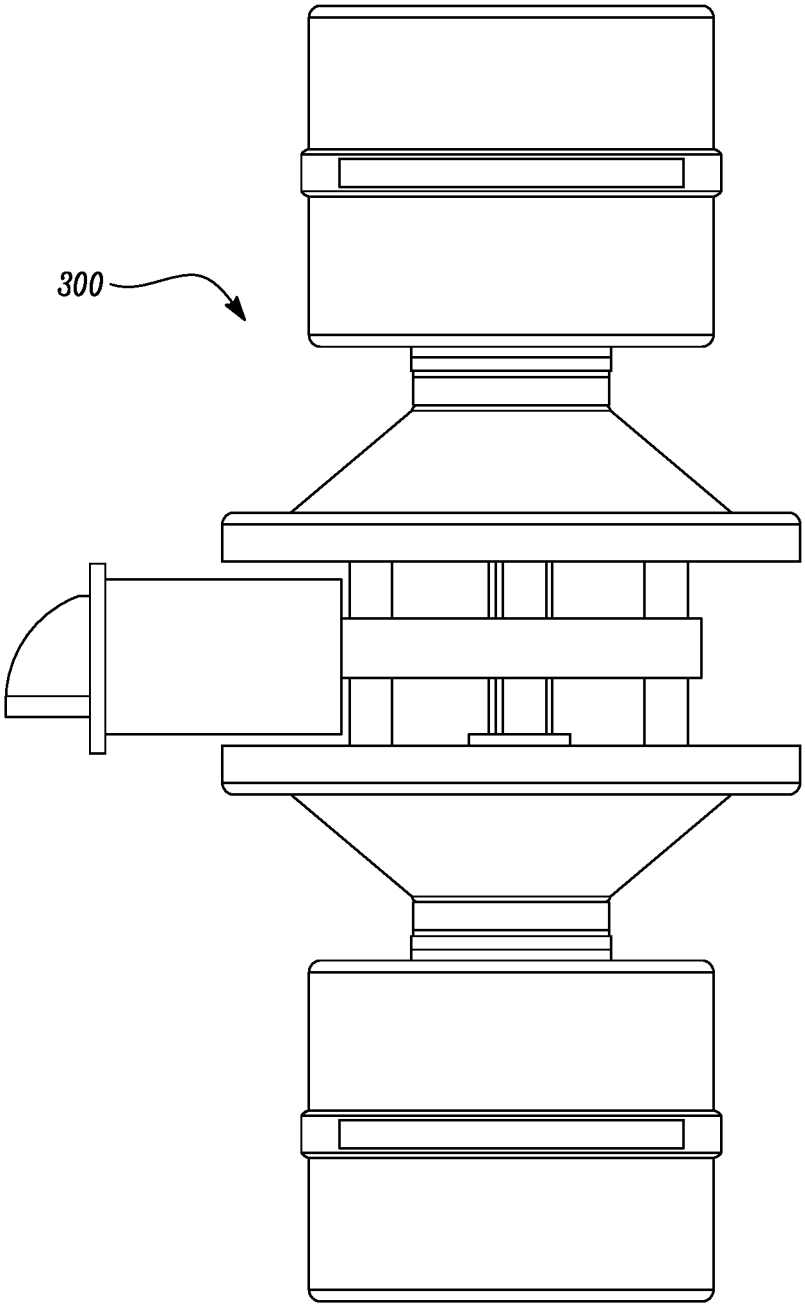
FIG. 18 is a top view of the locking system of FIG. 7.

As discussed, the collars 312 and 314 may be configured to be releasably secured to one another. When the collars 312 and 314 are releasably secured to one another, rotation of one would cause a corresponding rotation of the other. The collar 314 is operably coupled to the knob 302A such that rotation of the knob 302A causes a corresponding rotation of the collar 314. Thus, in an unlocked condition of the system 300, which occurs when the collar 314 is engaged (i.e., releasably secured) with the collar 312, rotation of the knob 302A causes a corresponding rotation of the spindle 308. Transitioning between locked and unlocked conditions (i.e., transitioning between disengagement and engagement (respectively) of the collars 312, 314 to one another may be accomplished either: (a) via translation or movement of a pin 318 by way of the keyed locking means including the keyed cylinder 309 which causes the pin 318 to pass through the aperture 312*b* of the collar 312 to engage the detent 314*b* of the collar 314; or (b) by magnetically causing the collar 312 to slide relative and toward the collar 314 to cause the two to become magnetically secured to one another. It should also be understood that when the magnetic force is applied, the spindle 308 itself may slide toward and engage the exterior knob 302A such that the two are operably coupled to one another in the unlocked condition and that when the magnetic force is no longer applied, the spindle 308 is no longer operably coupled to one another FIG. 12A illustrates an unlocked state of the locking system 300 and FIG. 12B illustrates a locked state of the locking system 300 by way of the keyed cylinder 309. Within the housing 301, there is provided a rotator collar 312 that engages a spindle 308 that is operably connected to the deadlocking plunger B. Rotation of the rotator collar 312 effects a corresponding rotation of the spindle 308 and unlocking/locking of the deadlocking plunger B depending on the direction of the rotation (i.e., clockwise or counter-clockwise). When a key 305 is inserted into the keyed cylinder 309 and the keyed cylinder 309 is rotated in a first direction, the keyed cylinder 309 urges a pushing member 307 to urge a pin 318 to be inserted into and through the rotator collar 312 and into the spindle 308 thus causing the rotator collar 312 to be operably to the knob 302A via the spindle 308.

Once the pin 318 is inserted into the collar 312, when the knob 302A is rotated and the collar 312 is thus correspondingly rotated, the pin 318 is maintained within the collar 312 by a generally U-shaped bracket 316 that approximates the circumference of the collar 312. In the initial position of the collar 312, the aperture 312*b* of the collar 312 may be aligned with the nadir of the U-shaped bracket 316 and the nadir of the bracket 316 may provide a space for the pin to exit the collar 312 such that it may transition to an unengaged condition therewith. A spring S2 may bias the pin 318 which toward an unengaged condition with respect to the rotator collar 312 such that when the rotator collar 312 is returned to its initial position and the keyed cylinder 309 in the unlocked position, the pin 318 exits the rotator collar 312 such that rotation of the rotator collar 312 such that rotation of the spindle 308 no longer occurs when the knob 302A is rotated. That is, when the pin 318 is not inserted through the aperture 312*b* of the rotator collar 312, the collars 312, 314 may be free to rotate relative one another and/or rotation of the knob 302A does not cause the collar 312 to effect rotation of the spindle 308. However, when the pin 318 is inserted through the aperture 312*b* of the rotator collar 312, the pin 318 engages a detent 314*a* of the knob collar 314 such that rotation of the knob 302A causes a corresponding movement of its rigidly connected collar 314 and the now secured rotator collar 312 that is secured to spindle 308. When the pin 318 is inserted through the collar 312, the pin 318 may contact a lateral surface of the spindle 308 such that rotation of the collar 312 causes the pin 318 to contact and rotate the spindle 308 as the collar 312 is rotated. As the collar 312 may be fixedly secured to the knob 302A, rotation of the knob 302A may cause the collar 312 to correspondingly rotate. In the locked condition, the collar 312 may not engage the spindle 308; whereas, in the unlocked condition (e.g., either when the collar 312 is releasably secured to the collar 314 or when the pin is inserted through the collar 312 and contacts a lateral surface of the spindle 308), rotation of the knob 302A which may be fixed relative to the collar 312 may effect rotation of the spindle 308, which causes retraction of the deadlocking plunger B which may retract upon rotation of the spindle 308.

As shown in FIGS. 12A-12B, the rotator collar 312 may have an internal configuration 3121 corresponding to that of the spindle 308 which may have a polygonal cross-section, e.g., a square. When in the unlocked condition, the rotator collar 312 is secured to the knob collar 314 via the pin 318 such that rotation of the exterior knob 302A effects rotation of the spindle 308 as the rotator collar 312 is rotatably secured relative to the spindle 308. In addition, the inside knob 302B may be rotatably fixed relative to the spindle 308 and only the knob 302A on the exterior side of the door may be transitionable been locked and unlocked states such that in both the unlocked and locked states the inside knob 302B functions to rotate the spindle 308 and causing the plunger B to disengage to permit opening of the door. Advantageously, the inside knob 302B can rotate the spindle 308 and permit opening of the door whether it is rotated clockwise or counterclockwise. Similarly, when in the unlocked condition, the outside knob 302A can also function to open the door, i.e., rotate the spindle 308 whether rotated in the clockwise or in counterclockwise direction. This is advantageous as a user might otherwise rotate the knob 302A or 302B in a direction that would not result in a corresponding rotation of the spindle 308.

Advantageously, the present disclosure provides a single, easy to install locking system that includes both an electronic, e.g., magnetic, locking means and a keyed locking means may be provided, which is desirable when for example, a user may not remember the passcode for entry into the keypad or when there is a power failure. As described the electrical locking means may include when the spindle 308 is magnetically attracted to and is thereby operably coupled to the exterior knob 302A by application of a current and the mechanical means for unlocking may include when the keyed mechanism is actuated to cause the collars 312 and 314 to be operably coupled to one another.

Having described at least one of the preferred embodiments of the present invention with reference to the accompanying drawings, it will be apparent to those skills that the invention is not limited to those precise embodiments, and that various modifications and variations can be made in the presently disclosed system without departing from the scope or spirit of the invention. Thus, it is intended that the present disclosure cover modifications and variations of this disclosure provided they come within the scope of the appended claims and their equivalents.

What is claimed is:

1. A locking system for a door, comprising:

a doorknob, a first plate;

a deadlocking plunger;

a spindle operably coupled to the deadlocking plunger, the spindle including a second plate;

a knob collar that is rotatably fixed relative to the doorknob;

a rotator collar that is rotatably fixed relative to the spindle, the knob collar engages the rotator collar such that the knob collar is rotatably fixed relative to the rotator collar in an unlocked condition and being rotatable relative to the rotator collar in the locked condition, wherein engagement of the rotator collar with the knob collar is effected via a selectable operation including a primary locking mechanism and a secondary locking mechanism, wherein the primary locking mechanism includes:

an electrical actuator that causes the first plate and the second plate to be magnetically attracted to one another when actuated such that rotation of the doorknob effects a corresponding rotation of the spindle; and wherein the secondary locking mechanism includes:

a detent that is formed in the knob collar and an aperture that extends through the rotator collar; and a pin that is translatable through the aperture to be disposed in the detent of the knob collar, when the secondary locking mechanism is in an unlocked condition, such that the knob collar and the rotator collar are rotatably fixed to one another.

2. The locking system of claim 1, wherein the doorknob is generally cylindrical and has a length, and further comprising:

a ring being centrally disposed along the length of the knob, the ring extending outward from a lateral surface of the knob, the ring providing a gripping surface for a user to manipulate the knob.

3. The locking system of claim 2, wherein opposing edges of the ring along a width of the ring are rounded.

4. The locking system of claim 2, wherein the ring is positioned substantially at a midpoint along the length of the doorknob, an alphanumeric keypad disposed on a proximal face of the doorknob, the alphanumeric keypad being configured to effect actuation of the magnetic force upon entry of a code using the alphanumeric keypad.

5. The locking system of claim 1, further comprising a U-shaped bracket that supports the pin, the U-shaped bracket being movable in a first direction toward the rotator collar and a second direction away from the rotator collar.

6. The locking system of claim 1, further comprising a biasing member that biases the U-shaped bracket away from the rotator collar.

7. The locking system of claim 6, further comprising a keyed cylinder that is rotatable in a first direction to effect movement of the U-shaped bracket toward the rotator collar and that is rotatable in a second direction to effect movement of the U-shaped bracket away from the rotator collar.

8. The locking system of claim 1, further comprising a power source that when actuated causes the first and second plates to be magnetically attracted to one another.

9. The locking system of claim 8, wherein the power source is housed within the doorknob.

10. The locking system of claim 1, wherein the knob collar includes a first detent that is configured to receive a portion of the pin extending through the aperture of the rotator collar.

11. The locking system of claim 10, wherein the pin remains within the first detent in both the unlocked and locked conditions, and wherein in the unlocked condition, the pin extends through an aperture extending through the first detent to contact a lateral surface of the spindle.

12. The locking system of claim 5, wherein the pin is biased away from the detent of the knob collar.

13. The locking system of claim 5, wherein both the knob collar and the rotator collar are disposed around the spindle, and wherein the knob collar is freely rotatable about the perimeter of spindle in the locked condition.

* * * * *